US005988373A

United States Patent [19]

Yates

[11] Patent Number: 5,988,373

[45] Date of Patent: Nov. 23, 1999

[54] PACKAGING SYSTEM

[76] Inventor: Paul M. Yates, 5814 Briar Tree Dr., LaCanada, Calif. 91011

[21] Appl. No.: 08/922,659

[22] Filed: Sep. 3, 1997

[51] Int. Cl.[6] ..... B65D 73/00; B65D 85/18

[52] U.S. Cl. ..... 206/296; 206/292; 206/806; 40/664; 211/113

[58] Field of Search ..... 206/278, 296, 206/493, 806; 211/113; 40/664

[56] References Cited

U.S. PATENT DOCUMENTS

| | | | |
|---|---|---|---|
| 2,264,957 | 12/1941 | Shafarman | 211/113 X |
| 2,682,122 | 6/1954 | Hanson | 206/278 X |
| 2,732,934 | 1/1956 | Hall | 206/278 |
| 3,085,725 | 4/1963 | Caparosa | 206/806 X |
| 3,334,736 | 8/1967 | Cole et al. | 206/278 X |
| 4,132,316 | 1/1979 | Schmidt, Jr. | 211/113 X |
| 4,485,917 | 12/1984 | Smith | 206/278 |
| 4,714,156 | 12/1987 | Kolton et al. | 206/296 |
| 4,718,546 | 1/1988 | Kolton et al. | 206/278 X |
| 4,765,467 | 8/1988 | Kolton et al. | 206/296 |
| 5,014,957 | 5/1991 | Nichol, Jr. | 206/806 X |
| 5,027,945 | 7/1991 | Wilkins | 206/296 X |
| 5,193,676 | 3/1993 | Gold | 206/296 |
| 5,240,120 | 8/1993 | McDonough | 206/495 X |
| 5,439,120 | 8/1995 | Brozak | 206/806 X |
| 5,487,617 | 1/1996 | Cole et al. | 206/806 X |
| 5,553,706 | 9/1996 | Gold | 206/296 |
| 5,593,025 | 1/1997 | Ffeibelman | 206/806 X |

FOREIGN PATENT DOCUMENTS

| | | | |
|---|---|---|---|
| 422244 | 1/1935 | United Kingdom | 206/296 |

*Primary Examiner*—Sue A. Weaver
*Attorney, Agent, or Firm*—Walter A. Hackler

[57] ABSTRACT

A packaging system is provided for displaying merchandise on a rack which includes at least two separate pieces of merchandise and a header for engaging the rack. The header includes a pair of opposing shoulders disposed in a spaced apart relationship with a bottom of the header, and filaments enable coupling of the pieces of merchandise to one another and to the opposing pair of shoulders in a manner enabling the merchandise to be removed from the rack with the header, inspected and tested, without affecting the coupling of the merchandise to one another or to the header.

14 Claims, 2 Drawing Sheets

PACKAGING SYSTEM

The invention is generally directed to a packaging system and in particular to a packaging system for displaying items on a rack system of a type common to self-service marketing and even more particularly to an improved packaging system for securing a header card to items which are intended to be displayed in pairs on a rack system.

Rack systems provide a useful and convenient method for presenting and displaying merchandise for sale. They can be provided, for example, on counter tops, as wall mounted units or as floor mounted units in order to achieve optimum utilization of available space.

Many different types of merchandise can be displayed on rack systems. Among the types of merchandise commonly displayed are wearing apparel such as gloves, mittens, hats, ski masks, scarves, socks and the like.

In the case of wearing apparel, it is desirable for a consumer to be able to try on and inspect the merchandise prior to making a purchase. Direct contact and the availability to try on the article will often encourage a consumer to make a purchase, especially an impulse purchase, if the merchandise is properly sized and well constructed.

One of the difficulties that arises in the case of merchandise displayed on rack systems is that handling the merchandise is often inconvenient and unwieldy as a result of the manner in which the merchandise is packaged. For example, one common method of displaying merchandise on rack systems is to package the merchandise in plastic bags. Such bags are often heat sealed, thereby making it impossible to inspect the merchandise without opening the bag. Since bags of this type are not presentable for sale once they have been opened, opening the bags is generally not encouraged. From the retailer's perspective, however, they cannot actively prevent the customers from trying on the merchandise to locate the appropriate size or check the fit. Unfortunately, this results in loose and mixed up pairs.

In an effort to overcome this dilemma, plastic bags with openable closures have been introduced. These bags permit the merchandise to be replaced into the bags and resealed without rendering the bags and enclosed merchandise unsuitable for sale. However, this leads to further problems in that consumers often fail to replace the merchandise. Consequently, the area surrounding the rack system becomes messy and unattractive. Furthermore, merchandise that is typically sold in pairs such as gloves, mittens, socks and other items are often separated when removed from the bags.

In addition, plastic bags cause environmental damage both in their manufacture and in their disposal. Such environmentally damaging packaging is rapidly becoming unacceptable in view of today's increased environmental awareness.

Another approach that is commonly used is the attachment of gloves, socks or other small articles with plastic tag attachers which keep the pair of gloves or socks together under display conditions. However, either the customers are unable to try on the gloves or socks because the plastic tag prevents this or the customer rips the plastic tag and, if the customer doesn't buy the gloves or socks, the gloves or socks are then loose and can be difficult to match back into pairs.

Yet, another approach is shown in U.S. Pat. No. 5,553,706, which discloses merchandise, such as gloves and the like, secured to a header by means of cords passing through openings in the header. While this arrangement enables the merchandise and header to be removed from a rack and tried on, or inspected, without affecting the attachment of the merchandise to the header, it has the disadvantage that such continued use may eventually rupture the openings in the headers, thus allowing one or more of the cords supporting the goods to come loose, which may result in detachment of the merchandise from the header or non-uniform support of the merchandise from the header. Naturally, the likelihood of this occurrence is more frequent if rough handling of the merchandise occurs.

The present invention overcomes this disadvantage by supporting the merchandise from the header without the use of holes which may become ruptured.

SUMMARY OF THE INVENTION

The packaging system in accordance with the present invention for displaying merchandise on a rack generally includes at least two pieces of merchandise along with a header which provides means for engaging the rack.

Coupling means are provided for attaching at least two pieces of merchandise to one another and to the header. In addition, the coupling means function to enable the pieces of merchandise to be removed from the rack with the header means, inspected and tested without affecting the attachment of the pieces of merchandise to one another or the header. Shoulder means are provided which are formed into the header for supporting the coupling means.

More particularly, the header includes a pair of opposing shoulders disposed in a spaced apart relationship with the bottom of the header and the coupling means comprises a continuous linear member, preferably, two continuous linear members which may be separate spaced apart loops of filament.

Importantly, the opposing shoulders have a length for preventing either of the two continuous linear members from passing thereover when the two continuous linear members are attached to pieces of merchandise. The loop and shoulder arrangement also provides an additional advantage for greater movement of the merchandise when it is inspected, since the filaments are not restricted in movement along the shoulders as they are in the prior art in which similar filaments pass through holes in a header.

Still more particularly the packaging system in accordance with the present invention may include merchandise such as pairs of gloves, pairs of mittens, pairs of mitts, pairs of socks, pairs of stockings, pairs of anklets or, for example, pairs of knee socks.

BRIEF DESCRIPTION OF THE DRAWINGS

The advantages and features of the present invention would be better understood by the following description when considered in conjunction with the accompanying drawings in which.

DETAILED DESCRIPTION

Figure 1:
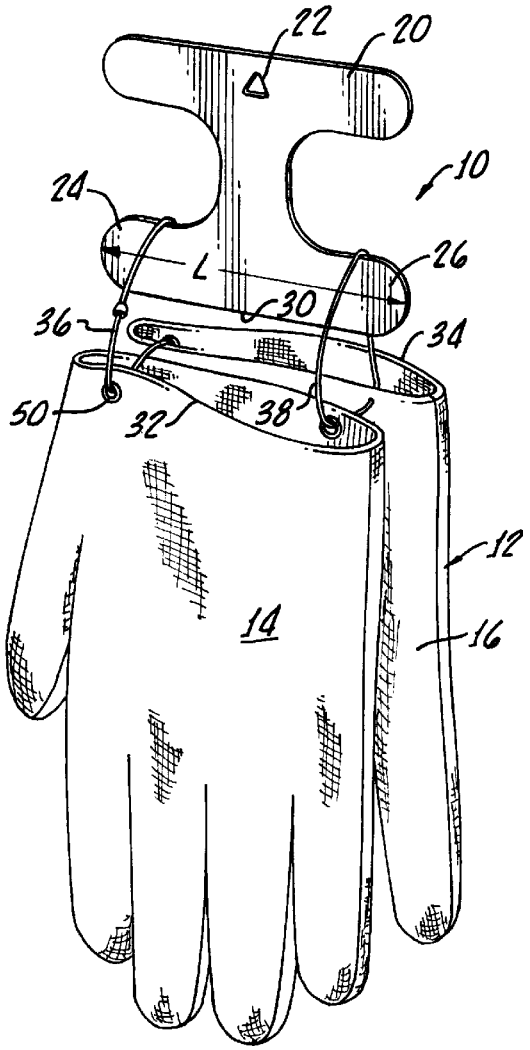
FIG. 1 is a perspective view of a packaging system in accordance with the present invention showing particularly a pair of gloves attached to a shouldered header.
Figure 2:
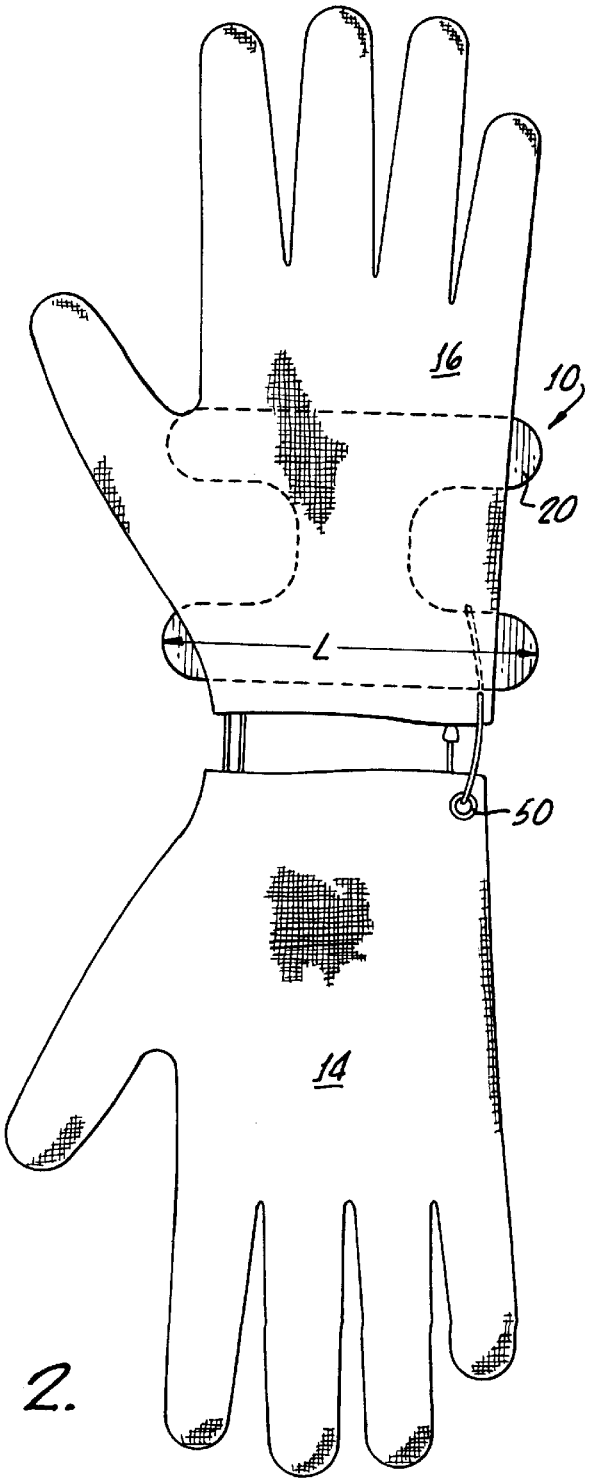
FIG. 2 is a plan view of the packaging system including the gloves shown in FIG. 1.

Turning now to FIGS. 1 and 2, there is shown a packaging system 10 for displaying merchandise, such as a pair 12 of gloves, 14, 16 on a rack, not shown.

The system 10 has best advantage when displaying at least two separate pieces, i.e., gloves 14, 16, of merchandise, the utility being hereinafter described in greater detail.

Header 20, which may be made from any suitable material, such as plastic or cardboard, provides a means for engaging a rack, pin or rod, not shown, by way of a hole 22 therein in order to support the pair 12 of gloves 14, 16, in a depending fashion below the header 20 and the rack, not shown.

Importantly, the header 20 includes a pair of opposing shoulders 24, 26 disposed in a spaced apart relationship, with a bottom 30 of the header and proximate ends 32, 34 of the gloves 14, 16, respectively.

Linear members 36, 38 which may be formed from any suitable plastic or fibrous material provide a coupling means for attaching the gloves 14, 16 to one another and to the header 20 in a manner enabling the gloves 14, 16 to be removed from the rack with the header means, inspected and tested, without affecting the attachment of the gloves 14, 16 to one another and to the header 20. FIG. 2 more particularly shows the position of the gloves 14, 16 when removed from the rack and enabling the inspection and testing thereof.

Figure 3:
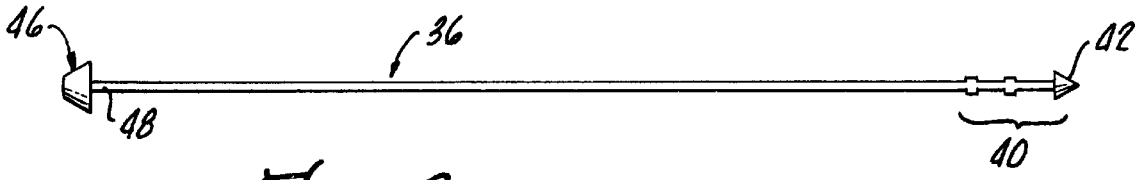
FIG. 3 is plan view of a typical linear member, or filament, utilized for coupling the gloves shown in FIGS. 1 and 2 to the shouldered header shown in FIGS. 1 and 2.

FIG. 3 shows a typical filament 36, which may be of any conventional type having an insertable mechanism 40 at one end 42 thereof and a receiving mechanism 46 disposed at another end 48 of the filament 36. It should be appreciated that as hereinabove noted any suitable closure mechanisms may be utilized in connection with the filament 36, 38. Of course, it is preferable that such filament establish loops in a non-separable manner, as is well known in the art.

Importantly, the opposing shoulders 24, 26 have in combination, a length, L, which provides a means for preventing either of the two continuous linear members, or filaments, 36, 38 from passing thereover when the filaments 36, 38 are attached to the merchandise, or gloves 12, 16. To effect this result, the loops of filaments 36, 38, which are disposed over the shoulders 24, 26 are of a length preventing, in combination with the length, L, of the shoulders, passage of the filaments 36, 38 over the shoulders 24, 26 when the gloves 26 are examined and tested, as for example, in a position shown in FIG. 2.

It should also be appreciated that the shoulders 24, 26 may be particularly shaped or formed with uprising end portions thereon, not shown, which would further facilitate the prevention of the filaments 36, 38 from being slid, or passed thereover.

Holes 50 may be formed in the gloves 14, 16, however, it is preferred that the insertion mechanism 40 pass through woven fabric or the like, without producing permanent holes therein, as is well known in the art.

Figure 4:
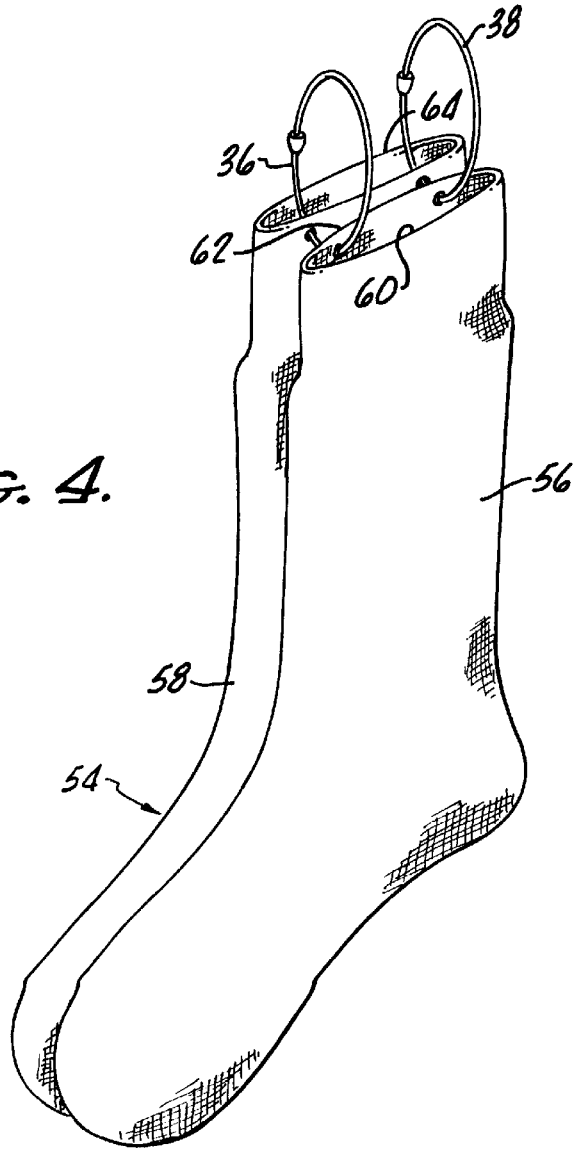
FIG. 4 is a perspective view of a packaging system in accordance with the present invention for displaying merchandise, in particular a pair of socks.

The system 10 may incorporate various pairs of merchandise, such as, for example, a pair of 12 gloves 14, 16, a pair of mitts (not shown), a pair of mittens (not shown), a pair 54 of socks 56, 58, see FIG. 4, a pair of stockings (not shown), a pair of anklets (not shown) and/or a pair of knee socks (not shown).

As shown in FIG. 4, the socks 56, 58 may include holes 60, for filaments 36, 38, disposed near an upward edge 62, 64 of the socks 56, 58, or alternatively, the filament 36 may be utilized alone with the insertion mechanism 40 passing through the weave of the socks 56, 58.

Although there has been hereinabove described a specific embodiment of a packaging system in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art should be considered to be within the scope of the present invention as defined in the appended claims.

What is claimed is:

1. A packaging system for displaying merchandise on a rack, said packaging system comprising:

at least two separate pieces of merchandise;

header means for engaging the rack;

coupling means for attaching the at least two pieces of merchandise to one another and to said header means and for enabling the at least two pieces of merchandise to be removed from the rack with said header, means, inspected and tested without affecting the attachment of the at least two pieces of merchandise to one another or said header means; and shoulder means, including a pair of opposing ends, formed into said header means along a perimeter thereof, for supporting said coupling means, said coupling means being supported by said shoulder means proximate the shoulder means opposing ends.

2. The packaging system according to claim 1 wherein said coupling means comprises a continuous linear member.

3. The packaging system according to claim 1 wherein said coupling means comprises two continuous linear members.

4. The packaging system according to claim 3 wherein said shoulder means comprises means, defining a length of each of the opposing shoulders, for preventing either of the two continuous linear members from passing thereover when the two continuous linear members are attached to the pieces of merchandise.

5. The packaging system according to claim 4 wherein the two continuous linear members comprise two separate spaced apart loops of filament.

6. The packaging system according to claim 5 wherein each of the loops is disposed over one of the opposing shoulders.

7. The packaging system according to claim 5 wherein the at least two pieces of merchandise is selected from a group consisting of a pair of gloves, a pair of mitts, a pair of mittens, a pair of socks, a pair of stockings a pair of anklets and a pair of knee socks.

8. A packaging system for displaying merchandise on a rack, said packaging system comprising:

at least two separate pieces of merchandise;

header means for engaging the rack, said header means having a pair of opposing shoulders disposed along a perimeter of said header means and in a spaced apart relationship with a bottom of said header means; and coupling means for coupling the at least two pieces of merchandise to one another and Proximate ends of the opposing pair of shoulders in a manner enabling the at least two pieces of merchandise to be removed from the rack with said header means, inspected and tested without affecting the coupling of the at least two pieces of merchandise to one another or said header means.

9. The packaging system according to claim 8 wherein said coupling means comprises a continuous linear member.

10. The packaging system according to claim 8 wherein said coupling means comprises two spaced apart linear members.

11. The package system according to claim 10 wherein the linear members comprise two separate spaced apart loops of filament.

12. The packaging system according to claim 11 wherein each of the loops is disposed over one of the opposing shoulders.

13. The packaging system according to claim 12 wherein said header means further comprises means, defining a length of each shoulder, for preventing either of the loops from passing thereover when the loops are coupled with the pieces of merchandise.

14. The packaging system according to claim 13 wherein the at least two pieces of merchandise is selected from a group consisting of a pair of gloves, a pair of mitts, a pair of mittens, a pair of socks, a pair of stockings, a pair of anklets and a pair of knee socks.

* * * * *